US006769625B2

(12) United States Patent
Peterson, Jr.

(10) Patent No.: US 6,769,625 B2
(45) Date of Patent: Aug. 3, 2004

(54) SPRAY PATTERN CONTROL WITH NON-ANGLED ORIFICES IN FUEL INJECTION METERING DISC

(75) Inventor: William A. Peterson, Jr., Smithfield, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 258 days.

(21) Appl. No.: 10/162,759

(22) Filed: Jun. 6, 2002

(65) Prior Publication Data

US 2003/0015595 A1 Jan. 23, 2003

Related U.S. Application Data

(60) Provisional application No. 60/296,565, filed on Jun. 6, 2001.

(51) Int. Cl.[7] ..... F02M 59/00; F02M 39/00; F02D 1/06

(52) U.S. Cl. ..... 239/5; 239/533.2; 239/533.3; 239/533.12; 239/533.14; 239/88

(58) Field of Search ..... 239/5, 533.2, 533.3, 239/533.8, 533.9, 533.14, 585.1–585.5, 596, 533.12, 494, 497, 88–93; 251/129.15, 129.21

(56) References Cited

U.S. PATENT DOCUMENTS

| | | | | |
|---|---|---|---|---|
| 4,057,190 A | | 11/1977 | Kiwior et al. | 239/558 |
| 4,101,074 A | | 7/1978 | Kiwior | |
| 4,532,906 A | | 8/1985 | Hoppel | |
| 4,925,111 A | | 5/1990 | Foertsch et al. | 239/533.12 |
| 5,038,738 A | | 8/1991 | Hafner et al. | 123/470 |
| 5,244,154 A | | 9/1993 | Bucholz et al. | 239/590.3 |
| 5,449,114 A | | 9/1995 | Wells et al. | |
| 5,516,047 A | | 5/1996 | Kubach et al. | 239/585.5 |
| 5,577,666 A | * | 11/1996 | Shen | 239/290 |
| 5,730,368 A | | 3/1998 | Flik et al. | 239/575 |
| 5,766,441 A | | 6/1998 | Arndt et al. | 239/596 |
| 5,772,124 A | | 6/1998 | Tamaki et al. | 239/533.12 |
| 5,785,254 A | | 7/1998 | Zimmerman et al. | 239/490 |
| 5,862,991 A | | 1/1999 | Willke et al. | 239/397.5 |
| 5,875,972 A | * | 3/1999 | Ren et al. | 239/463 |
| 5,931,391 A | | 8/1999 | Tami et al. | 239/533.12 |
| 6,039,272 A | * | 3/2000 | Ren et al. | 239/597 |
| 6,102,299 A | | 8/2000 | Pace et al. | 239/533.12 |
| 6,170,763 B1 | | 1/2001 | Fuchs et al. | 239/533.12 |
| 6,394,367 B2 | | 5/2002 | Mune Zane et al. | 239/533.12 |
| 2002/0063175 A1 | | 5/2002 | Kitamura et al. | |

FOREIGN PATENT DOCUMENTS

| | | |
|---|---|---|
| EP | 1 092 865 A | 4/2001 |
| EP | 1 154 151 | 11/2001 |
| JP | 10-122096 | 12/1998 |
| JP | 2000-097129 | 4/2000 |
| WO | WO 00/52328 | 9/2000 |

OTHER PUBLICATIONS

European Search Report, EP 01 20 1450, Aug. 1, 2001.
PCT/US02/17941; International Search Report, Sep. 25, 2002.

* cited by examiner

*Primary Examiner*—Davis Hwu

(57) ABSTRACT

A valve subassembly of a fuel injector that allows spray targeting and distribution of fuel to be configured using non-angled or straight orifice having an axis parallel to a longitudinal axis of the subassembly. Metering orifices are located about the longitudinal axis and defining a first virtual circle greater than a second virtual circle defined by a projection of the sealing surface onto the metering disc so that all of the metering orifices are disposed outside the second virtual circle. The projection of the sealing surface converges at a virtual apex disposed within the metering disc. At least one channel extends between a first end and second end. The first end is disposed at a first radius from the longitudinal axis and spaced at a first distance from the metering disc. The second end is disposed at a second radius with respect to the longitudinal axis and spaced at a second distance from the metering disc such that a product of the first radius and the first distance is approximately equal to a product of the second radius and the second distance. Methods of controlling spray distribution and targeting are also provided.

18 Claims, 5 Drawing Sheets

FIG. 4
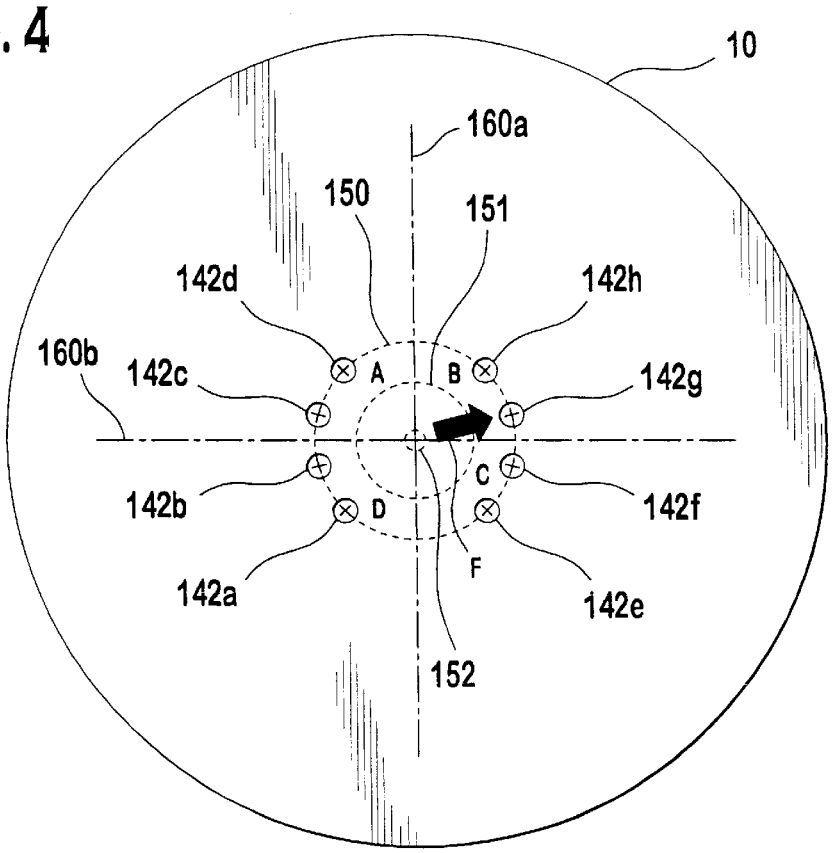
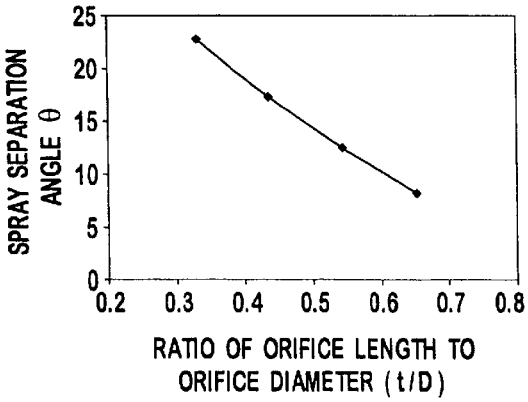
FIG. 5A
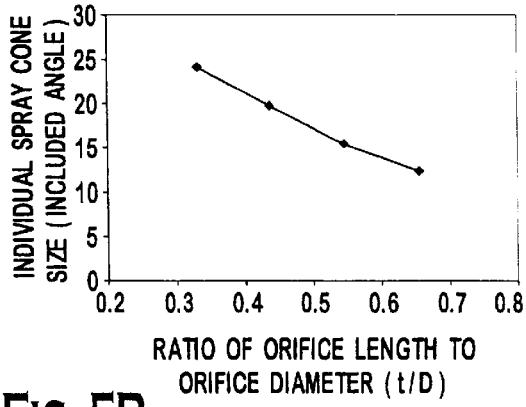
FIG. 5B

FIG. 6A
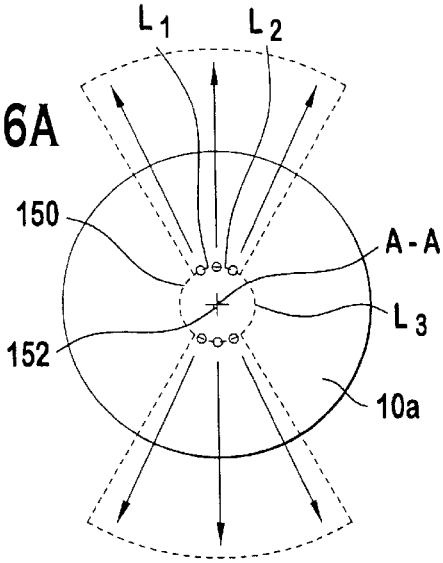
FIG. 6B
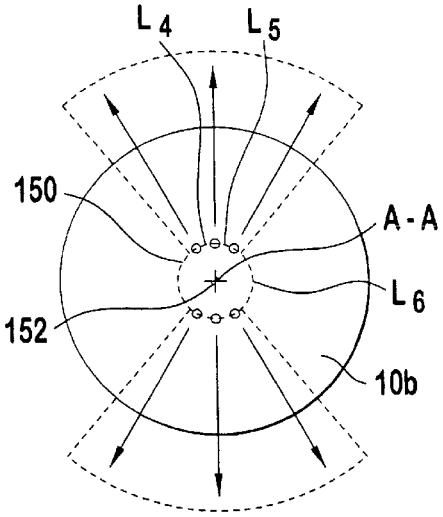
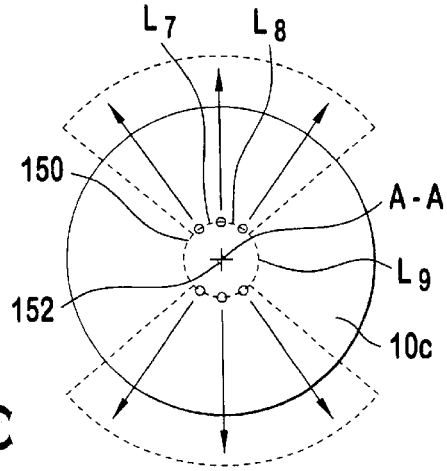
FIG. 6C

SPRAY PATTERN CONTROL WITH NON-ANGLED ORIFICES IN FUEL INJECTION METERING DISC

This application claims the benefits of U.S. provisional patent application Ser. No. 60/296,565 filed on Jun. 6, 2001, which provisional patent application is herein incorporated by reference in its entirety.

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electro-magnetic fuel injector typically utilizes a solenoid assembly to supply an actuating force to a fuel metering assembly. Typically, the fuel metering assembly is a plunger-style needle valve which reciprocates between a closed position, where the needle is seated in a seat to prevent fuel from escaping through a metering orifice into the combustion chamber, and an open position, where the needle is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration.

It would be beneficial to develop a fuel injector in which increased atomization and precise targeting can be changed so as to meet a particular fuel targeting and cone pattern from one type of engine configuration to another type.

It would also be beneficial to develop a fuel injector in which non-angled metering orifices can be used in controlling atomization, spray targeting and spray distribution of fuel.

SUMMARY OF THE INVENTION

The present invention provides fuel targeting and fuel spray distribution with non-angled metering orifices. In a preferred embodiment, a fuel injector is provided. The fuel injector comprises a housing, a seat, a metering disc and a closure member. The housing has an inlet, an outlet and a longitudinal axis extending therethrough. The seat is disposed proximate the outlet. The seat includes a sealing surface, an orifice, and a first channel surface. The metering disc includes a second channel surface confronting the first channel surface. The closure member is reciprocally located within the housing along the longitudinal axis between a first position wherein the closure member is displaced from the seat, allowing fuel flow past the closure member, and a second position wherein the closure member is biased against the seat, precluding fuel flow past the closure member. The metering disc has a plurality of metering orifices extending therethrough along the longitudinal axis. The metering orifices are located about the longitudinal axis and define a first virtual circle greater than a second virtual circle defined by a projection of the sealing surface onto a metering disc so that all of the metering orifices are disposed outside the second virtual circle. The projection of the sealing surface converges at a virtual apex disposed within the metering disc. A controlled velocity channel is formed between the first and second channel surfaces, the controlled velocity channel having a first portion changing in cross-sectional area as the channel extends outwardly from the orifice of the seat to a location cincturing the plurality of metering orifices, such that a flow path exiting through each of the metering orifices forms a spray angle oblique to the longitudinal axis.

In another preferred embodiment, a seat subassembly is provided. The seat subassembly includes a seat, a metering disc contiguous to the seat, and a longitudinal axis extending therethrough. The seat includes a sealing surface, an orifice, and a first channel surface. The metering disc includes a second channel surface confronting the first channel surface. The metering disc has a plurality of metering orifices extending therethrough along the longitudinal axis. The metering orifices are located about the longitudinal axis and define a first virtual circle greater than a second virtual circle defined by a projection of the sealing surface onto a metering disc so that all of the metering orifices are disposed outside the second virtual circle. The projection of the sealing surface converges at a virtual apex disposed within the metering disc. A controlled velocity channel is formed between the first and second channel surfaces, the controlled velocity channel having a first portion changing in cross-sectional area as the channel extends outwardly from the orifice of the seat to a location cincturing the plurality of metering orifices, such that a flow path exiting through each of the metering orifices forms a spray angle oblique to the longitudinal axis.

In yet another embodiment, a method of controlling a spray angle of fuel flow through at least one metering orifice of a fuel injector is provided. The fuel injector has an inlet and an outlet and a passage extending along a longitudinal axis therethrough. The outlet has a seat and a metering disc. The seat has a seat orifice and a first channel surface extending obliquely to the longitudinal axis. The metering disc includes a second channel surface confronting the first channel surface so as to provide a frustoconical flow channel. The metering disc has a plurality of metering orifices extending therethrough along the longitudinal axis and located about the longitudinal axis. The method is achieved, in part, by locating the metering orifices on a first virtual circle outside of a second virtual circle formed by an extension of a sealing surface of the seat such that the metering orifices extend generally parallel to the longitudinal axis; and imparting a radial velocity to the fuel flowing from the seat orifice through the controlled flow channel, so that a flow path through each of the metering orifices forms a spray angle oblique to the longitudinal axis.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

FIG. 4 illustrates a preferred embodiment of the metering disc arranged on a bolt circle.

FIGS. 5A and 5B illustrate a relationship between a ratio t/D of each metering orifice with respect to either spray separation angle or individual spray cone size for a specific configuration of the fuel injector.

FIGS. 6A, 6B, and 6C illustrate how a spray pattern can be adjusted by adjusting an arcuate distance between the metering orifices on a bolt circle.

DETAILED DESCRIPTION OF THE PREFERRED EMBODIMENTS

Figure 1:
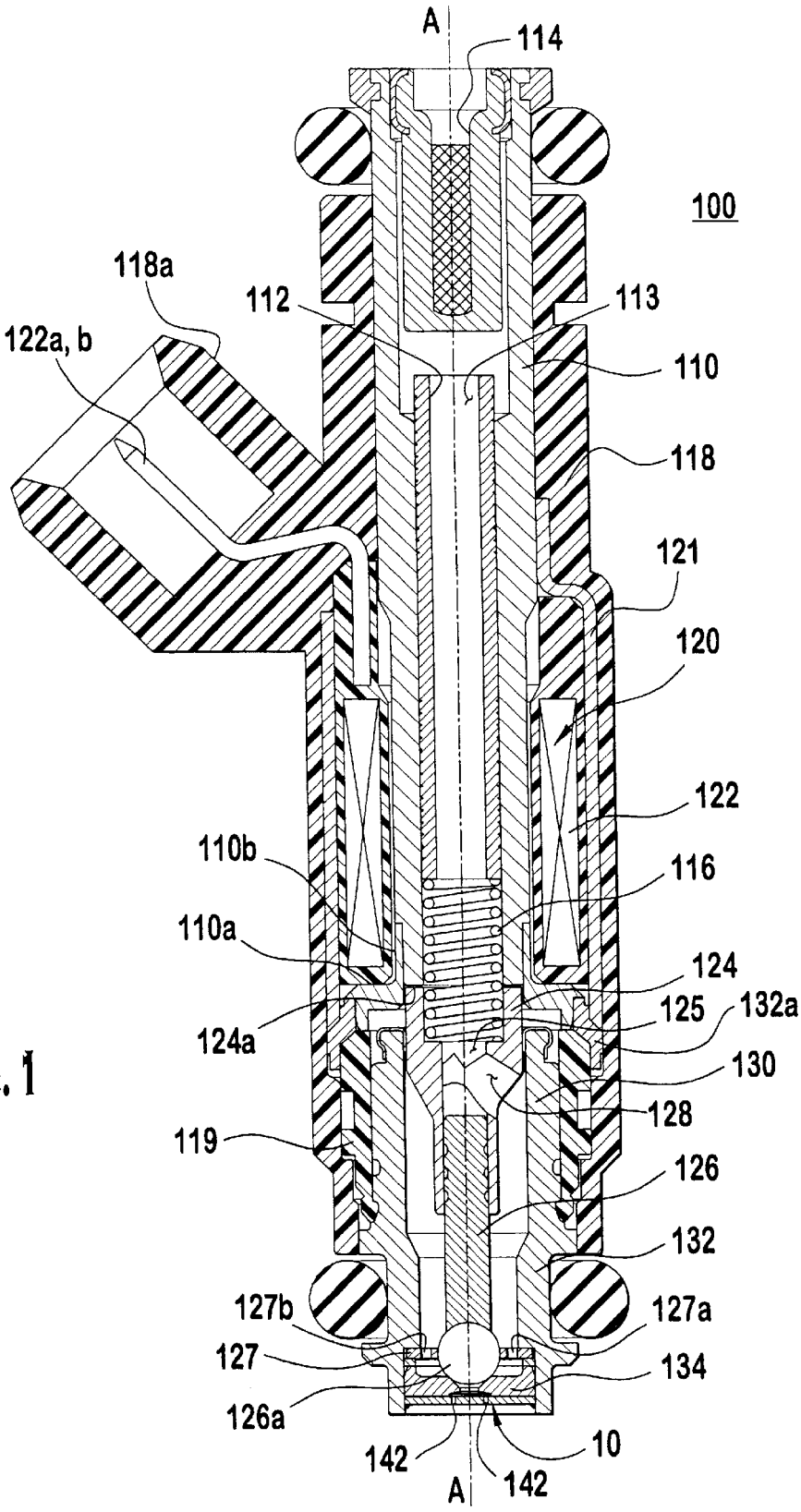
FIG. 1 illustrates a preferred embodiment of the fuel injector.

FIGS. 1–6 illustrate the preferred embodiments. In particular, a fuel injector 100 having a preferred embodiment of the metering disc 10 is illustrated in FIG. 1. The fuel injector 100 includes: a fuel inlet tube 110, an adjustment tube 112, a filter assembly 114, a coil assembly 118, a coil spring 116, an armature 124, a closure member 126, a non-magnetic shell 110*a*, a first overmold 118, a valve body 132, a valve body shell 132*a*, a second overmold 119, a coil assembly housing 121, a guide member 127 for the closure member 126, a seat 134, and a metering disc 10.

The guide member 127, the seat 134, and the metering disc 10 form a stack that is coupled at the outlet end of fuel injector 100 by a suitable coupling technique, such as, for example, crimping, welding, bonding or riveting. Armature 124 and the closure member 126 are joined together to form an armature/needle valve assembly. It should be noted that one skilled in the art could form the assembly from a single component. Coil assembly 120 includes a plastic bobbin on which an electromagnetic coil 122 is wound.

Respective terminations of coil 122 connect to respective terminals 122*a*, 122*b* that are shaped and, in cooperation with a surround 118*a* formed as an integral part of overmold 118, to form an electrical connector for connecting the fuel injector to an electronic control circuit (not shown) that operates the fuel injector.

Fuel inlet tube 110 can be ferromagnetic and includes a fuel inlet opening at the exposed upper end. Filter assembly 114 can be fitted proximate to the open upper end of adjustment tube 112 to filter any particulate material larger than a certain size from fuel entering through inlet opening before the fuel enters adjustment tube 112.

In the calibrated fuel injector, adjustment tube 112 has been positioned axially to an axial location within fuel inlet tube 110 that compresses preload spring 116 to a desired bias force that urges the armature/needle valve such that the rounded tip end of closure member 126 can be seated on seat 134 to close the central hole through the seat. Preferably, tubes 110 and 112 are crimped together to maintain their relative axial positioning after adjustment calibration has been performed.

After passing through adjustment tube 112, fuel enters a volume that is cooperatively defined by confronting ends of inlet tube 110 and armature 124 and that contains preload spring 116. Armature 124 includes a passageway 128 that communicates volume 125 with a passageway 113 in valve body 130, and guide member 127 contains fuel passage holes 127*a*, 127*b*. This allows fuel to flow from volume 125 through passageways 113, 128 to seat 134.

Non-ferromagnetic shell 110*a* can be telescopically fitted on and joined to the lower end of inlet tube 110, as by a hermetic laser weld. Shell 110*a* has a tubular neck that telescopes over a tubular neck at the lower end of fuel inlet tube 110. Shell 110*a* also has a shoulder that extends radially outwardly from neck. Valve body shell 132*a* can be ferromagnetic and can be joined in fluid-tight manner to non-ferromagnetic shell 110*a*, preferably also by a hermetic laser weld.

The upper end of valve body 130 fits closely inside the lower end of valve body shell 132*a* and these two parts are joined together in fluid-tight manner, preferably by laser welding. Armature 124 can be guided by the inside wall of valve body 130 for axial reciprocation. Further axial guidance of the armature/needle valve assembly can be provided by a central guide hole in member 127 through which closure member 126 passes.

Prior to a discussion of the description of components of a seat subassembly proximate the outlet end of the fuel injector 100, it should be noted that the preferred embodiments of a seat and metering disc of the fuel injector 100 allow for a targeting of the fuel spray pattern (i.e., fuel spray separation) to be selected without relying on angled orifices. Moreover, the preferred embodiments allow the cone pattern (i.e., a narrow or large divergent cone spray pattern) to be selected based on the preferred spatial orientation of straight (i.e. parallel to the longitudinal axis) orifices.

Figure 2A:
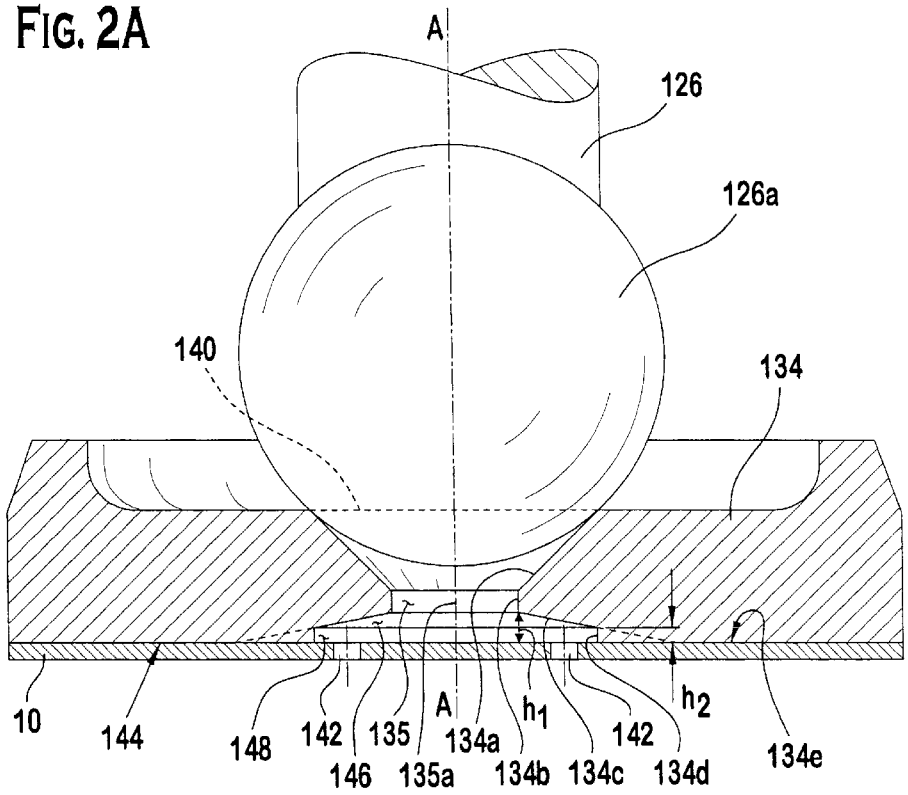
FIG. 2A illustrates a close-up cross-sectional view of an outlet end of the fuel injector of FIG. 1.

Referring to a close up illustration of the seat subassembly of the fuel injector in FIG. 2A which has a closure member 126, seat 134, and a metering disc 10. The closure member 126 includes a spherical surface shaped member 126*a* disposed at one end distal to the armature. The spherical member 126*a* engages the seat 134 on seat surface 134*a* so as to form a generally line contact seal between the two members. The seat surface 134*a* tapers radially downward and inward toward the seat orifice 135 such that the surface 134*a* is oblique to the longitudinal axis A—A. The words "inward" and "outward" refer to directions toward and away from, respectively, the longitudinal axis A—A. The seal can be defined as a sealing circle 140 formed by contiguous engagement of the spherical member 126*a* with the seat surface 134*a*, shown here in FIGS. 2A and 3. The seat 134 includes a seat orifice 135, which extends generally along the longitudinal axis A—A of the housing 20 and is formed by a generally cylindrical wall 134*b*. Preferably, a center 135*a* of the seat orifice 135 is located generally on the longitudinal axis A—A.

Figure 2B:
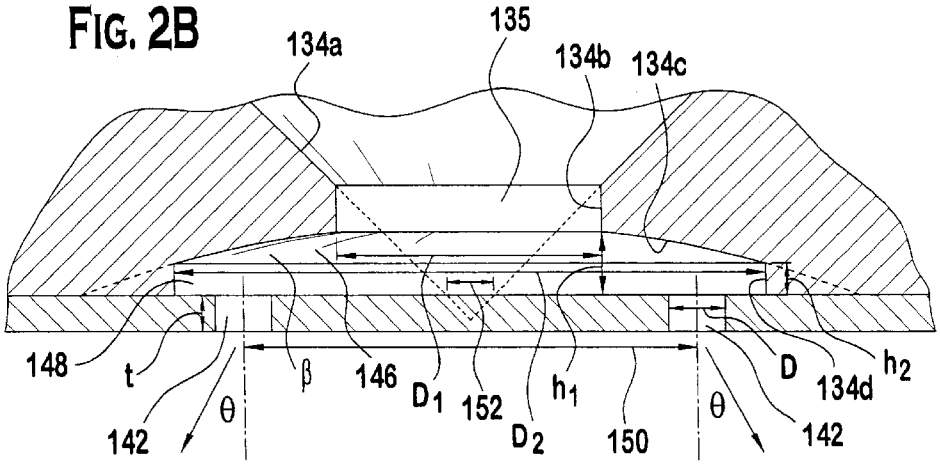
FIG. 2B illustrates a further close-up view of the preferred embodiment of the seat subassembly that, in particular, shows the various relationships between various components in the subassembly.
Figure 2C:
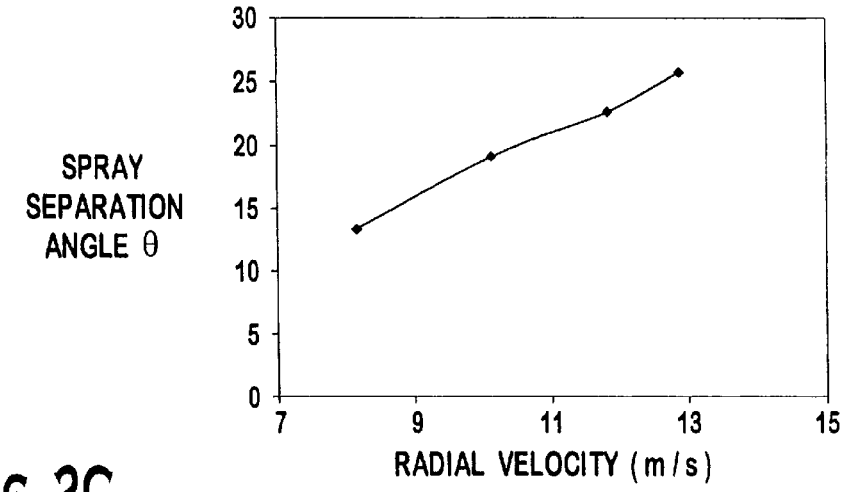
FIG. 2C illustrates a generally linear relationship between spray separation angle of fuel spray exiting the metering orifice to a radial velocity component of a seat subassembly

Downstream of the circular wall 134*b*, the seat 134 tapers along a portion 134*c* towards the metering disc surface 134*e*. The taper of the portion 134*c* preferably can be linear or curvilinear with respect to the longitudinal axis A—A, such as, for example, a curvilinear taper that forms an interior dome (FIG. 2B). In one preferred embodiment, the taper of the portion 134*c* is linearly tapered (FIG. 2A) downward and outward at a taper angle β away from the seat orifice 135 to a point radially past the metering orifices 142. At this point, the seat 134 extends along and is preferably parallel to the longitudinal axis so as to preferably form cylindrical wall surface 134*d*. The wall surface 134*d* extends downward and subsequently extends in a generally radial direction to form a bottom surface 134*e*, which is preferably perpendicular to the longitudinal axis A—A. In another preferred embodiment, the portion 134*c* can extend through to the surface 134*e* of the seat 134. Preferably, the taper angle β is about 10 degrees relative to a plane transverse to the longitudinal axis A—A.

The interior face 144 of the metering disc 10 proximate to the outer perimeter of the metering disc 10 engages the bottom surface 134*e* along a generally annular contact area. The seat orifice 135 is preferably located wholly within the perimeter, i.e., a "bolt circle" 150 defined by an imaginary line connecting a center of each of the metering orifices 142. That is, a virtual extension of the surface of the seat 135 generates a virtual orifice circle 151 preferably disposed within the bolt circle 150.

The cross-sectional virtual extensions of the taper of the seat surface 134*b* converge upon the metering disc so as to generate a virtual circle 152 (FIGS. 2B and 4). Furthermore, the virtual extensions converge to an apex located within the cross-section of the metering disc 10. In one preferred embodiment, the virtual circle 152 of the seat surface 134*b* is located within the bolt circle 150 of the metering orifices. Stated another way, the bolt circle 150 is preferably entirely outside the virtual circle 152. Although the metering orifices 142 can be contiguous to the virtual circle 152, it is preferable that all of the metering orifices 142 are also outside the virtual circle 152.

Figure 3:
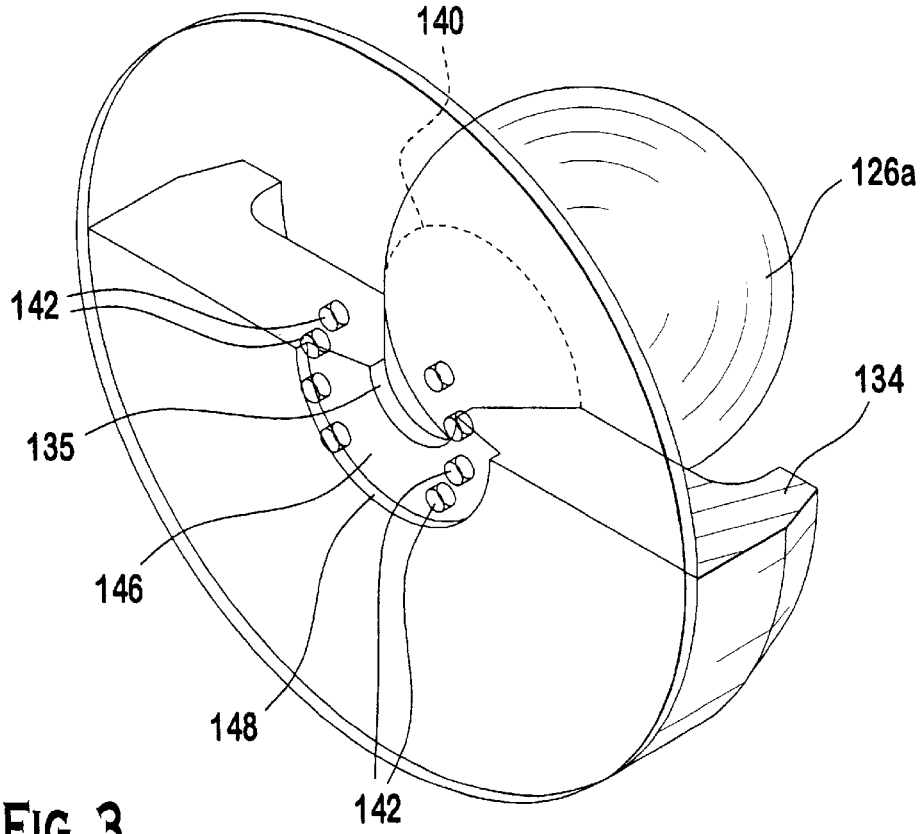
FIG. 3 illustrates a perspective view of outlet end of the fuel injector of FIG. 2A.

A generally annular controlled velocity channel 146 is formed between the seat orifice 135 of the seat 134 and interior face 144 of the metering disc 10, illustrated here in FIG. 2A. Specifically, the channel 146 is initially formed between the intersection of the preferably cylindrical surface 134*b* and the preferably linearly tapered surface 134*c*, which channel terminates at the intersection of the preferably cylindrical surface 134*d* and the bottom surface 134*e*. In other words, the channel changes in cross-sectional area as the channel extends outwardly from the orifice of the seat to the plurality of metering orifices such that fuel flow is imparted with a radial velocity between the orifice and the plurality of metering orifices. A physical representation of a particular relationship has been discovered that allows the controlled velocity channel 146 to provide a constant velocity to fluid flowing through the channel 146. In this relationship, the channel 146 tapers outwardly from a larger height $h_1$ at the seat orifice 135 with corresponding radial distance $D_1$ to a smaller height $h_2$ with corresponding radial distance $D_1$ toward the metering orifices 142. Preferably, a product of the height $h_1$, distance $D_1$ and π is approximately equal to the product of the height $h_2$, distance $D_2$ and π (i.e. $D_1*h_1*\pi=D_2*h_2*\pi$ or $D_1*h_1=D_2*h_2$) formed by a taper, which can be linear or curvilinear. The distance $h_2$ is believed to be related to the taper in that the greater the height $h_2$, the greater the taper angle β is required and the smaller the height $h_2$, the smaller the taper angle β is required. An annular space 148, preferably cylindrical in shape with a length $D_2$, is formed between the preferably linear wall surface 134*d* and an interior face of the metering disc 10. That is, as shown in FIGS. 2A and 3, a frustum formed by the controlled velocity channel 146 downstream of the seat orifice 135, which frustum is contiguous to preferably a right-angled cylinder formed by the annular space 148.

By providing a constant velocity of fuel flowing through the controlled velocity channel 146, it is believed that a sensitivity of the position of the metering orifices 142 relative to the seat orifice 135 in spray targeting and spray distribution is minimized. That is to say, due to manufacturing tolerances, acceptable level concentricity of the array of metering orifices 142 relative to the seat orifice 135 may be difficult to achieve. As such, features of the preferred embodiment are believed to provide a metering disc for a fuel injector that is believed to be less sensitive to concentricity variations between the array of metering orifices 142 on the bolt circle 150 and the seat orifice 135. It is also noted that those skilled in the art will recognize that from the particular relationship, the velocity can decrease, increase or both increase/decrease at any point throughout the length of the channel 146, depending on the configuration of the channel, including varying $D_1$, $h_1$, $D_2$ or $h_2$ of the controlled velocity channel 146, such that the product of $D_1$ and $h_1$ can be less than or greater than the product of $D_2$ and $h_2$.

In another preferred embodiment, the cylinder of the annular space 148 is not used and instead only a frustum forming part of the controlled velocity channel 146 is formed. That is, the channel surface 134*c* extends all the way to the surface 134*e* contiguous to the metering disc 10, referenced in FIGS. 2A and 2B as dashed lines. In this embodiment, the height $h_2$ can be referenced by extending the distance $D_2$ from the longitudinal axis A—A to a desired point transverse thereto and measuring the height $h_2$ between the metering disc 10 and the desired point of the distance $D_2$.

By imparting a different radial velocity to fuel flowing through the seat orifice 135, it has been discovered that the spray separation angle of fuel spray exiting the metering orifices 142 can be changed as a generally linear function of the radial velocity. For example, in a preferred embodiment shown here in FIG. 2C, by changing a radial velocity of the fuel flowing (between the orifice 135 and the metering orifices 142 through the controlled velocity channel 146) from approximately 8 meter-per-second to approximately 13 meter-per-second, the spray separation angle changes correspondingly from approximately 13 degrees to approximately 26 degrees. The radial velocity can be changed preferably by changing the configuration of the seat subassembly (including $D_1$, $h_1$, $D_2$ or $h_2$ of the controlled velocity channel 146), changing the flow rate of the fuel injector, or by a combination of both.

Furthermore, it has also been discovered that spray separation targeting can also be adjusted by varying a ratio of the through-length (or orifice length) "t" of each metering orifice to the diameter "D" of each orifice. In particular, the spray separation angle is linearly and inversely related, shown here in FIG. 5A for a preferred embodiment, to the ratio t/D. Here, as the ratio changes from approximately 0.3 to approximately 0.7, the spray separation angle θ generally changes linearly and inversely from approximately 22 degrees to approximately 8 degrees. Hence, where a small cone size is desired but with a large spray separation angle, it is believed that spray separation can be accomplished by configuring the velocity channel 146 and space 148 while cone size can be accomplished by configuring the t/D ratio of the metering disc 10. It should be noted that the ratio t/D not only affects the spray separation angle, it also affects a size of the spray cone emanating from the metering orifice in a linear and inverse manner, shown here in FIG. 5B. In FIG. 5B, as the ratio changes from approximately 0.3 to approximately 0.7, the cone size, measured as an included angle, changes generally linearly and inversely to the ratio t/D. Although the through-length "t" (i.e., the length of the metering orifice along the longitudinal axis A—A) is shown in FIG. 2B as being substantially the same as that of the thickness of the metering disc 10, it is noted that the thickness of the metering disc can be different from the through-length t of the metering orifice 142.

The metering or metering disc 10 has a plurality of metering orifices 142, each metering orifice 142 having a center located on an imaginary "bolt circle" 150 shown here in FIG. 4. For clarity, each metering orifice is labeled as 142*a*, 142*b*, 142*c*, 142*d* . . . and so on. Although the metering orifices 142 are preferably circular openings, other orifice configurations, such as, for examples, square, rectangular, arcuate or slots can also be used. The metering orifices 142 are arrayed in a preferably circular configuration, which configuration, in one preferred embodiment, can be generally concentric with the virtual circle 152. A seat orifice virtual circle 151 is formed by a virtual projection of the orifice 135 onto the metering disc such that the seat orifice virtual circle 151 is outside of the virtual circle 152 and preferably generally concentric to both the first and second virtual circle 150. Extending from the longitudinal axis A—A are two perpendicular lines 160*a* and 160*b* that along with the bolt circle 150 divide the bolt circle into four contiguous quadrants A, B, C and D. In a preferred embodiment, the metering orifices on each quadrant are diametrically disposed with respect to corresponding metering orifices on a distal quadrant. The preferred configuration of the metering orifices 142 and the channel allows a flow path "F" of fuel extending radially from the orifice 135 of the seat in any one radial direction away from the longitudinal axis towards the metering disc passes to one metering orifice or orifice.

In addition to spray targeting with adjustment of the radial velocity and cone size determination by the controlled velocity channel and the ratio t/D, respectively, a spatial orientation of the non-angled orifice openings 142 can also be used to shape the pattern of the fuel spray by changing the arcuate distance "L" between the metering orifices 142 along a bolt circle 150. FIGS. 6A–6C illustrate the effect of arraying the metering orifices 142 on progressively larger arcuate distances between the metering orifices 142 so as to achieve increases in the individual cone sizes of each metering orifice 142 with corresponding decreases in the spray separation angle. This effect can be seen starting with metering disc 10*a* and moving through metering disc 10*c*.

In FIG. 6A, relatively close arcuate distances $L_1$ and $L_2$ (where $L_1=L_2$ and $L_3>L_2$ in a preferred embodiment) of the metering orifice relative to each other form a narrow cone pattern. In FIG. 6B, spacing the metering orifices 142 at a greater arcuate distance (where $L_4=L_5$ and $L_6>L_4$ in a preferred embodiment) than the arcuate distances in FIG. 6A form a relatively wider cone pattern at a relatively smaller spray angle. In FIG. 6C, an even wider cone pattern at an even smaller spray angle is formed by spacing the metering orifices 142 at even greater arcuate distances (where $L_7=L_8$ and $L_9>L_7$ in a preferred embodiment) between each metering orifice 142. It should be noted that in these examples, the arcuate distance $L_1$ can be greater than or less than $L_2$, $L_4$ can be greater or less than $L_5$ and $L_7$ can be greater than or less than $L_8$.

The adjustment of arcuate distances can also be used in conjunction with the process previously described so as to tailor the spray geometry (narrower spray pattern with greater spray angle to wider spray pattern but at a smaller spray angle by) of a fuel injector to a specific engine design while using non-angled metering orifices (i.e. openings having an axis generally parallel to the longitudinal axis A—A).

In operation, the fuel injector 100 is initially at the non-injecting position shown in FIG. 1. In this position, a working gap exists between the annular end face 110*b* of fuel inlet tube 110 and the confronting annular end face 124*a* of armature 124. Coil housing 121 and tube 12 are in contact at 74 and constitute a stator structure that is associated with coil assembly 18. Non-ferromagnetic shell 110*a* assures that when electromagnetic coil 122 is energized, the magnetic flux will follow a path that includes armature 124. Starting at the lower axial end of housing 34, where it is joined with valve body shell 132*a* by a hermetic laser weld, the magnetic circuit extends through valve body shell 132*a*, valve body 130 and eyelet to armature 124, and from armature 124 across working gap 72 to inlet tube 110, and back to housing 121.

When electromagnetic coil 122 is energized, the spring force on armature 124 can be overcome and the armature is attracted toward inlet tube 110 reducing working gap 72. This unseats closure member 126 from seat 134 open the fuel injector so that pressurized fuel in the valve body 132 flows through the seat orifice and through orifices formed on the metering disc 10. It should be noted here that the actuator may be mounted such that a portion of the actuator can disposed in the fuel injector and a portion can be disposed outside the fuel injector. When the coil ceases to be energized, preload spring 116 pushes the armature/needle valve closed on seat 134.

As described, the preferred embodiments, including the techniques of controlling spray angle targeting and distribution are not limited to the fuel injector described but can be used in conjunction with other fuel injectors such as, for example, the fuel injector sets forth in U.S. Pat. No. 5,494,225 issued on Feb. 27, 1996, or the modular fuel injectors set forth in U.S. patent application Ser. No. 09/828,487 filed on Apr. 9, 2001, which is pending, and wherein both of these documents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A fuel injector comprising:

a housing having an inlet, an outlet and a longitudinal axis extending therethrough;

a seat, the seat including a sealing surface, an orifice, a first channel surface, a terminal seat surface and a longitudinal axis extending therethrough;

a metering disc contiguous to the seat, the metering disc including a second channel surface confronting the first channel surface, the metering disc having a plurality of metering orifices extending generally parallel to the longitudinal axis, the metering orifices being located about the longitudinal axis and defining a first virtual circle greater than a second virtual circle defined by a projection of the sealing surface onto a metering disc so that all of the metering orifices are disposed outside the second virtual circle;

a closure member being reciprocally located between a first position wherein the closure member is displaced from the seat, and a second position wherein the closure member is biased against the seat, precluding fuel flow past the closure member; and a controlled velocity channel formed between the first and second channel surfaces, the controlled velocity channel having a first portion changing in cross-sectional area as the channel extends outwardly from the orifice of the seat to a location cincturing the plurality of metering orifices, such that a flow path exiting through each of the metering orifices forms a spray angle oblique to the longitudinal axis.

2. The fuel injector of claim 1, wherein the plurality of metering orifices includes at least two metering orifices diametrically disposed on the first virtual circle.

3. The fuel injector of claim 1, wherein the plurality of metering orifices includes at least two metering orifices disposed at a first arcuate distance relative to each other on the first virtual circle.

4. The fuel injector of claim 1, wherein the plurality of metering orifices includes at least three metering orifices spaced at different arcuate distances on the first virtual circle.

5. The fuel injector of claim 1, wherein the plurality of metering orifices includes at least two metering orifices, each metering orifice having a through-length and an orifice diameter and configured such that an increase in a ratio of the through-length relative to the orifice diameter results in a decrease in the spray angle relative to the longitudinal axis.

6. The fuel injector of claim 1, wherein the plurality of metering orifices includes at least two metering orifices, each metering orifice having a through-length and an orifice diameter and configured such that an increase in a ratio of the through-length relative to the orifice diameter results in a decrease in an included angle of a spray cone produced by each metering orifice.

7. The fuel injector of claim 1, wherein the first portion extends from a first position contiguous to the seat orifice through a second position to the location contiguous to the terminal seat surface, the first position being located at a first distance from the longitudinal axis and at a first spacing along the longitudinal axis relative to the metering disc and the second position being located at a second distance from the longitudinal axis and a second spacing from the metering disc along the longitudinal axis, such that a product of the first distance and first spacing is generally equal to the a product of the second distance and second spacing.

8. The fuel injector of claim 1, wherein the projection of the sealing surface further converging at a virtual apex disposed within the metering disc, and the channel includes a second portion extending from the first portion, the second portion having a constant sectional area as the channel extends along the longitudinal axis.

9. The fuel injector of claim 8, wherein the first portion extends from a first position contiguous to the seat orifice to a second position contiguous to the second portion, the first position being located at a first distance from the longitudinal axis and at a first spacing along the longitudinal axis relative to the metering disc and the second position being located at a second distance from the longitudinal axis and at a second spacing from the metering disc along the longitudinal axis, such that a product of the first distance and first spacing is generally equal to the a product of the second distance and second spacing.

10. A seat subassembly comprising:

a seat having a sealing surface, an orifice, a first channel surface, a terminal seat surface and a longitudinal axis extending therethrough;

a metering disc contiguous to the seat, the metering disc including a second channel surface confronting the first channel surface, the metering disc having a plurality of metering orifices extending generally parallel to the longitudinal axis, the metering orifices being located about the longitudinal axis and defining a first virtual circle greater than a second virtual circle defined by a projection of the sealing surface onto a metering disc so that all of the metering orifices are disposed outside the second virtual circle; and a controlled velocity channel formed between the first and second channel surfaces, the controlled velocity channel having a first portion changing in cross-sectional area as the channel extends outwardly from the orifice of the seat to a location cincturing the plurality of metering orifices, such that a flow path exiting through each of the metering orifices forms a spray angle oblique to the longitudinal axis.

11. The seat subassembly of claim 10, wherein the plurality of metering orifices includes at least two metering orifices diametrically disposed on the first virtual circle.

12. The seat subassembly of claim 10, wherein the plurality of metering orifices includes at least two metering orifices disposed at a first arcuate distance relative to each other on the first virtual circle.

13. The seat subassembly of claim 10, wherein the plurality of metering orifices includes at least three metering orifices spaced at different arcuate distances on the first virtual circle.

14. The seat subassembly of claim 10, wherein the plurality of metering orifices includes at least two metering orifices, each metering orifice having a through-length and an orifice diameter and configured such that an increase in a ratio of the through-length relative to the orifice diameter results in a decrease in the spray angle relative to the longitudinal axis.

15. The seat subassembly of claim 10, wherein the plurality of metering orifices includes at least two metering orifices, each metering orifice having a through-length and an orifice diameter and configured such that an increase in a ratio of the through-length relative to the orifice diameter results in a decrease in an included angle of a spray cone produced by each metering orifice.

16. The seat subassembly of claim 10, wherein the first portion extends from a first position contiguous to the seat orifice through a second position to the location contiguous to the terminal seat surface, the first position being located at a first distance from the longitudinal axis and at a first spacing along the longitudinal axis relative to the metering disc and the second position being located at a second distance from the longitudinal axis and a second spacing from the metering disc along the longitudinal axis, such that a product of the first distance and first spacing is generally equal to the a product of the second distance and second spacing.

17. The seat subassembly of claim 10, wherein the projection of the sealing surface further converging at a virtual apex disposed within the metering disc, and the channel includes a second portion extending from the first portion, the second portion having a constant sectional area as the channel extends along the longitudinal axis.

18. The seat subassembly of claim 17, wherein the first portion extends from a first position contiguous to the seat orifice to a second position contiguous to the second portion, the first position being located at a first distance from the longitudinal axis and at a first spacing along the longitudinal axis relative to the metering disc and the second position being located at a second distance from the longitudinal axis and at a second spacing from the metering disc along the longitudinal axis, such that a product of the first distance and first spacing is generally equal to the a product of the second distance and second spacing.

* * * * *